US005559508A

United States Patent [19]

Orr et al.

[11] Patent Number: 5,559,508

[45] Date of Patent: Sep. 24, 1996

[54] EMERGENCY VEHICLE DETECTOR

[75] Inventors: Steven K. Orr, Loveland; Daniel G. Kindel, Mason, both of Ohio

[73] Assignee: Cincinnati Microwave, Inc., Cincinnati, Ohio

[21] Appl. No.: 288,335

[22] Filed: Aug. 10, 1994

[51] Int. Cl.[6] ..... G08G 1/0965

[52] U.S. Cl. ..... 340/902; 340/825.73

[58] Field of Search ..... 340/902, 903, 340/825.73, 825.76; 342/70, 20, 71, 72

[56] References Cited

U.S. PATENT DOCUMENTS

| | | | |
|---|---|---|---|
| 3,673,560 | 6/1972 | Barsh et al. | 340/33 |
| 3,735,342 | 5/1973 | Helliker et al. | 340/902 |
| 3,784,970 | 1/1974 | Simpkin | 340/33 |
| 3,873,963 | 3/1975 | Neal et al. | 340/34 |
| 3,997,868 | 12/1976 | Ribnick et al. | 340/33 |
| 4,238,778 | 12/1980 | Ohsumi | 340/33 |
| 4,443,790 | 4/1984 | Bishop | 340/539 |
| 4,587,522 | 5/1986 | Warren | 340/902 |
| 4,724,312 | 2/1988 | Snaper | 250/203 R |
| 4,785,474 | 11/1988 | Bernstein et al. | 340/902 |
| 4,794,394 | 12/1988 | Halstead | 340/902 |
| 5,278,553 | 1/1994 | Cornett et al. | 340/902 |

FOREIGN PATENT DOCUMENTS

| | | | |
|---|---|---|---|
| 1187586 | 5/1985 | Canada | 342/20 |
| 2319599 | 11/1974 | Germany | 340/902 |

OTHER PUBLICATIONS

Application (U.S.) Ser. No. 08/297,969.

Noah Webster, Webster's New International Dictionary, Jun. 22, 1950, p. 2051.

*Primary Examiner*—Stephen M. Johnson

*Attorney, Agent, or Firm*—Limbach & Limbach L.L.P.

[57] ABSTRACT

An emergency vehicle contains a transmitter for generating and transmitting a pair of fixed continuous wave signals which are distinguishable from each other in a preselected frequency band. A passenger vehicle contains a receiver which detects and distinguishes the pair of signals and generates an alert if the signals are determined to be at predetermined frequencies.

6 Claims, 4 Drawing Sheets

EMERGENCY VEHICLE DETECTOR

FIELD OF THE INVENTION

The present invention relates generally to radar detectors, and more particularly, to a method and apparatus for detecting emergency vehicles with a radar detector.

BACKGROUND

It has long been desirable to provide a system whereby drivers are alerted to the presence of emergency vehicles, such as those used by police and fire personnel, so that safe operation of passenger vehicles can be maintained.

U.S. Pat. No. 4,238,778 discloses an emergency vehicle warning system which includes an RF transmitter in the emergency vehicle and a receiver in other vehicles. The transmitter includes a single oscillator for generating a carder frequency of predetermined frequency. The receiver includes an antenna and bandpass filter, and the intensity of signals passed by the filter are compared to a predetermined intensity level to validate the signal and generate a warning.

U.S. Pat. No. 5,235,329 discloses an emergency vehicle detection system wherein a passenger vehicle includes a receiver sensitive to the frequency of a wave-borne signal generated by the emergency vehicle. The emergency vehicle transmits a signal in a broad frequency band, and the receiver located in the passenger vehicle generates an alert for any signals received within that frequency band. However, each emergency vehicle is configured to have a unique dead band somewhere in selected frequency band, and each emergency vehicle has a received designed to generate an alert only for signals it receives in that dead band. In that way, an emergency vehicle will be alerted to other emergency vehicles but will not alert based on its own signal.

Radar detectors, such as the ESCORT® and PASSPORT® radar detector products manufactured and sold by Cincinnati Microwave, Inc., assignee herein, are generally known and used by vehicle drivers for detecting the presence of police radar signals and generating an alert thereto, as disclosed in the following commonly assigned patents: U.S. Pat. No. 4,313,216; U.S. Pat. No. 4,581,769; U.S. Pat. No. 4,954,828; U.S. Pat. No. 5,049,885; U.S. Pat. No. 5,079,553; and U.S. Pat. No. 5,305,007. However, legislation has banned the use of such devices in many states and in interstate trucking. It has been proposed that such devices be used for other purposes, such as to detect emergency vehicles. However, no one has successfully developed such an application. Therefore, it would be desirable to utilize a radar detector to detect emergency vehicles and generate an alert for such detection.

SUMMARY OF THE INVENTION

According to the present invention, a system is provided for detecting emergency vehicles. A transmitter is mounted in an emergency vehicle for generating and transmitting a first signal and a second signal, wherein the first signal and the second signal are fixed at different frequencies of a preselected frequency band. In the preferred embodiment, the K band is selected. A receiver is carried in a second vehicle for detecting that the first signal and the second signal are in a predetermined location and for generating an alert upon such detection. The second signal may be selectable between two discrete frequencies such that two combinations of first and second signals are provided. In one position, the detected signals indicate a moving emergency vehicle. In the other position, the detected signals indicate a stationary emergency vehicle. Alternatively, two types of transmitters could be provided, one type to generate the first and second signal which indicate a moving emergency vehicle, and the other type to generate a second and a third signal which indicate a stationary emergency vehicle.

A better understanding of the features and advantages of the present invention will be obtained by reference to the following detailed description of the invention and accompanying drawings which set forth an illustrative embodiment in which the principles of the invention are utilized.

DETAILED DESCRIPTION OF THE INVENTION

Figure 1:
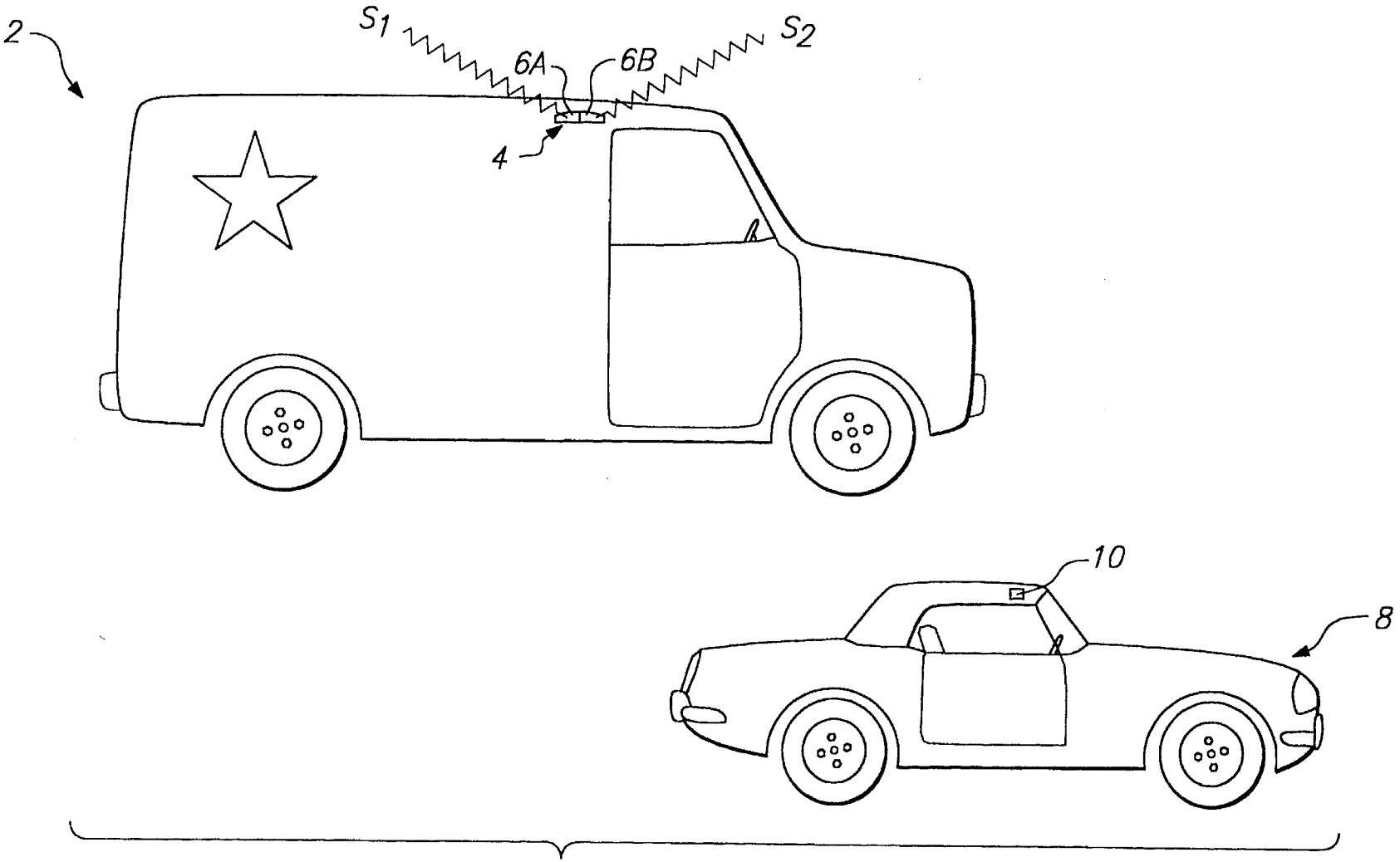
FIG. 1 is a schematic diagram showing an emergency vehicle and a passenger vehicle equipped with the emergency vehicle detection system of the present invention.

Referring now to FIG. 1, an emergency vehicle 2 is equipped with a transmitter 4 having two signal sources 6A and 6B for concurrently generating and transmitting a first signal $S_1$ and a second signal $S_2$, respectively. Preferably, the signals $S_1$ and $S_2$ are continuous wave signals fixed at specified frequencies located near opposite ends of the K band, which is defined by the Federal Communications Commission as 24.15+/–0.100 GHz. At a minimum, the signals $S_1$ and $S_2$ must be fixed at different frequencies in a preselected frequency band and be capable of discrimination by a receiver/detector unit.

In the preferred embodiment of the invention, two different types of signal sources are provided: one for moving vehicles and the other for stationary hazards. The receiver is adapted to detect and distinguish the different types of sources and to provide an alert corresponding to each type.

For example, in moving vehicles, transmitter source 6A generates the first signal $S_1$ as a continuous wave signal fixed at 24.110+/–0.020 GHz and transmitter source 6B generates the second signal $S_2$ as a continuous wave signal fixed at 24.230+/–0.020 GHz. For stationary vehicles, transmitter source 6A generates the first signal $S_1$ as a continuous wave signal fixed at 24.070+/–0.020 GHz and transmitter source 6B generates the second signal $S_2$ as a continuous wave signal fixed at 24.230+/–0.020 GHz. Thus, in the preferred embodiment, moving vehicles will transmit the first signal type, wherein the signals differ in frequency by 120 MHz, while stationary vehicles will transmit the second signal type, wherein the signals differ in frequency by 160 MHz. Other variations will be obvious to one skilled in the art, including the addition of more types of signal sources to differentiate other types of emergency vehicles or other mobile or stationary hazards. Further, the difference in frequency between signals need only be so large as to be distinguishable by the receiver. Filter technology is well known which can reduce the distinguishable difference to the order of a few MHz or less, but utilization of such technology is generally considered based on desired resolution and cost. For example, where the receiver generates both an s-curve and its image in response to a signal, as described below, a plurality of signals $S_1 \ldots S_n$ could be provided wherein the difference between signals is 40 MHz, and the receiver could adequately distinguish and alert for each signal or groups of signals. Image rejection schemes are also known, such as that employed in Cincinnati Microwave'S SOLO® radar detector, wherein the distinguishable difference is on the order of 20 MHz or less.

An emergency vehicle is preferably equipped with both types of signal sources and a means for selecting one or the other type. For example, a two position switch (not shown) may be operated between a first position if the emergency vehicle is moving and a second position if the emergency vehicle is stationary. Alternatively, a motion sensor (not shown) or other suitable switching means could be incorporated to automatically select between the two types of signal sources. In this way, passenger vehicles properly equipped as described below can determine from the received signals whether the emergency vehicle is moving or stationary.

Figure 2:
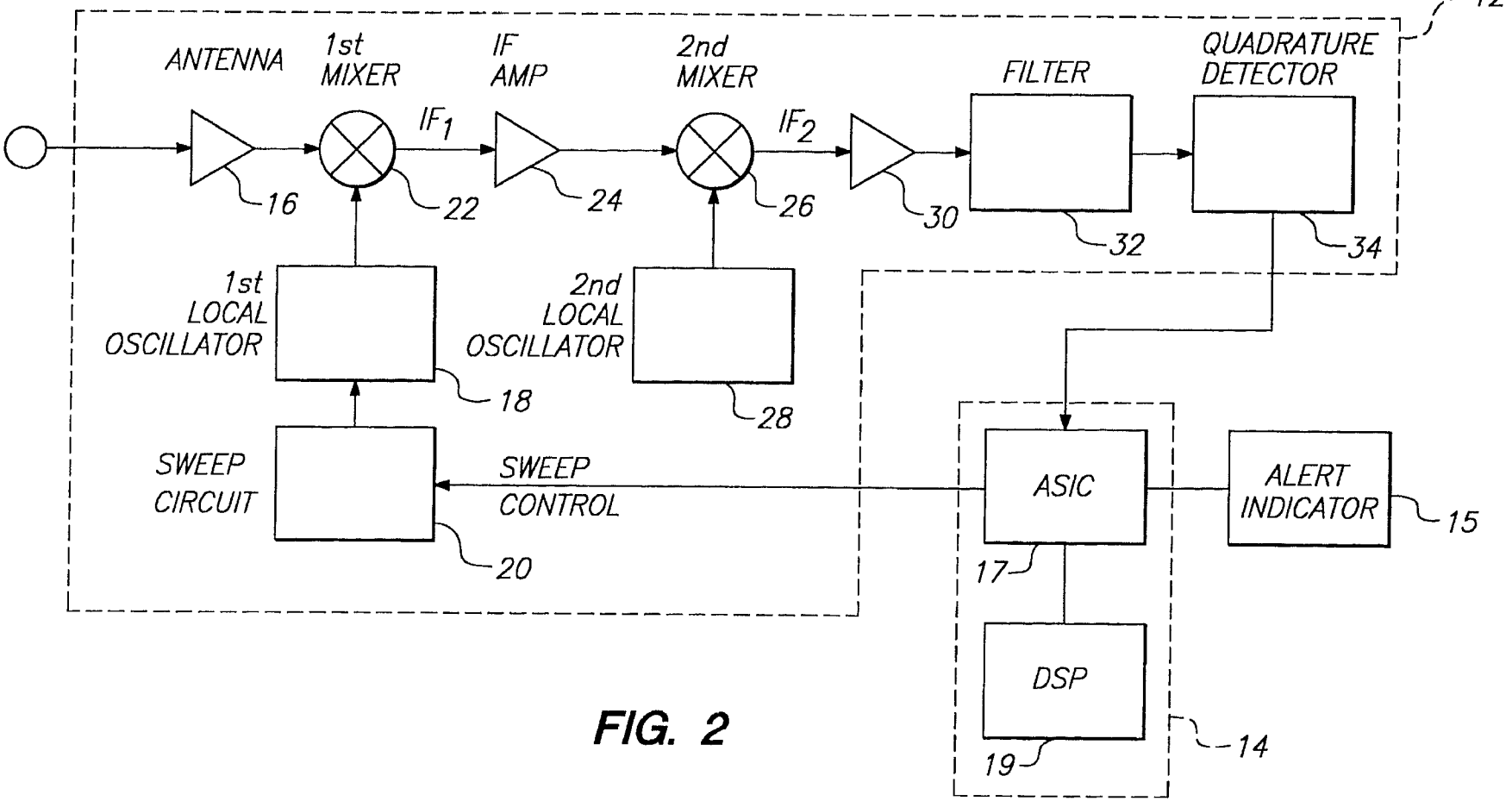
FIG. 2 is a block diagram of a radar detector configured according to the present invention.

A passenger vehicle 8 is equipped with a radar detector 10. As shown in FIG. 2, the radar detector 10 includes a microwave receiver section 12 coupled to a microprocessor section 14. The microprocessor section 14 includes sufficient hardware and/or software to evaluate the detected signals and generate an audible or visible alert on alert indicator 15. Typically, the microprocessor 14 may be programmed with appropriate instructions to evaluate signals which are detected by the receiver section 12.

Preferably, an application specific integrated circuit (ASIC) 17 is used to perform low rate signal processing, and a digital signal processor (DSP) chip 19 is used to perform high rate signal processing. Such a configuration is known, for example, from U.S. Pat. No. 5,305,007, the text of which is expressly incorporated herein by reference. Other detection configurations are generally known, for example, those shown in the following U.S. Patents which are also expressly incorporated herein by reference: U.S. Pat. No. 4,954,828; U.S. Pat. No. 5,049,885; and U.S. Pat. No. 5,079,553.

Generally, the receiver section 12 includes an antenna 16 for receiving incoming signals. A first local oscillator 18 is driven by a sweep circuit 20 to provide a signal which sweeps across the frequency band and which is mixed by first mixer 22 with the incoming signal to generate a first intermediate frequency signal $IF_1$. Signal $IF_1$ is amplified by IF amplifier 24 and mixed by second mixer 26 with a fixed signal from a second local oscillator 28 to generate a second intermediate frequency $IF_2$. Signal $IF_2$ is then amplified by amplifier 30, passed through bandpass filter 32, then amplified, limited and demodulated by quadrature detector 34 to generate as an output a pair of s-curves for each detected signal. As explained in U.S. Pat. No. 5,049,885, the s-curves define positions in time relative to the start of the sweep which correspond to the frequency at which the incoming signal is received.

Figure 3A:
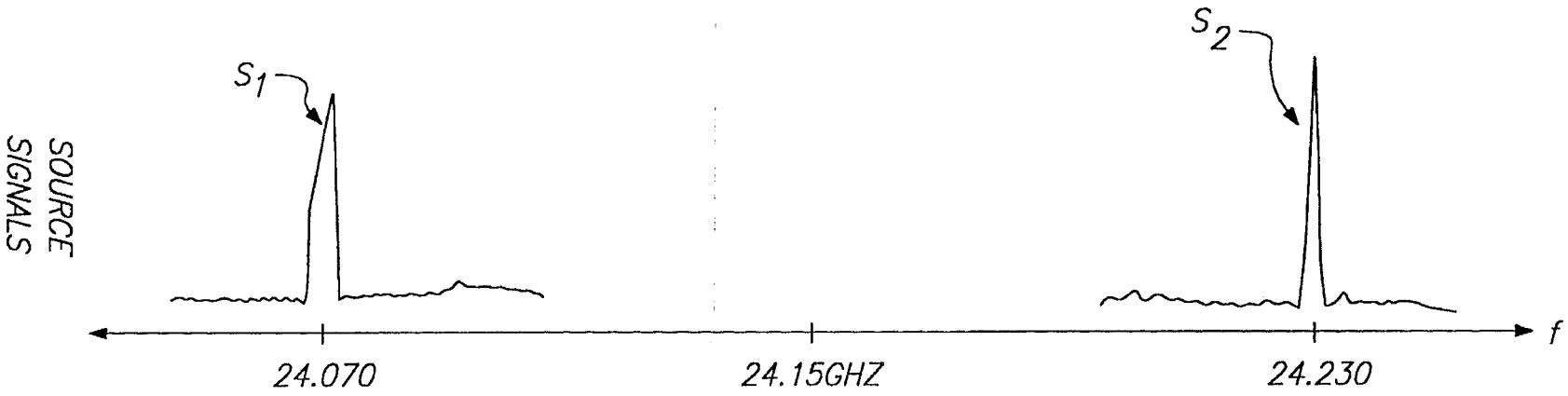
FIG. 3 A is a graphical representation of the transmitted signals from an emergency vehicle.
FIG. 3B is a graphical representation of the output from the quadrature detector portion of the present invention.
Figure 3B:
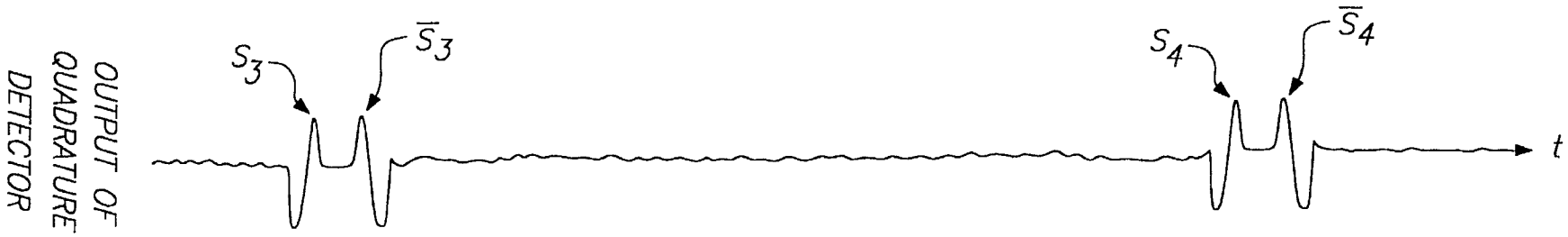
Figure 4:
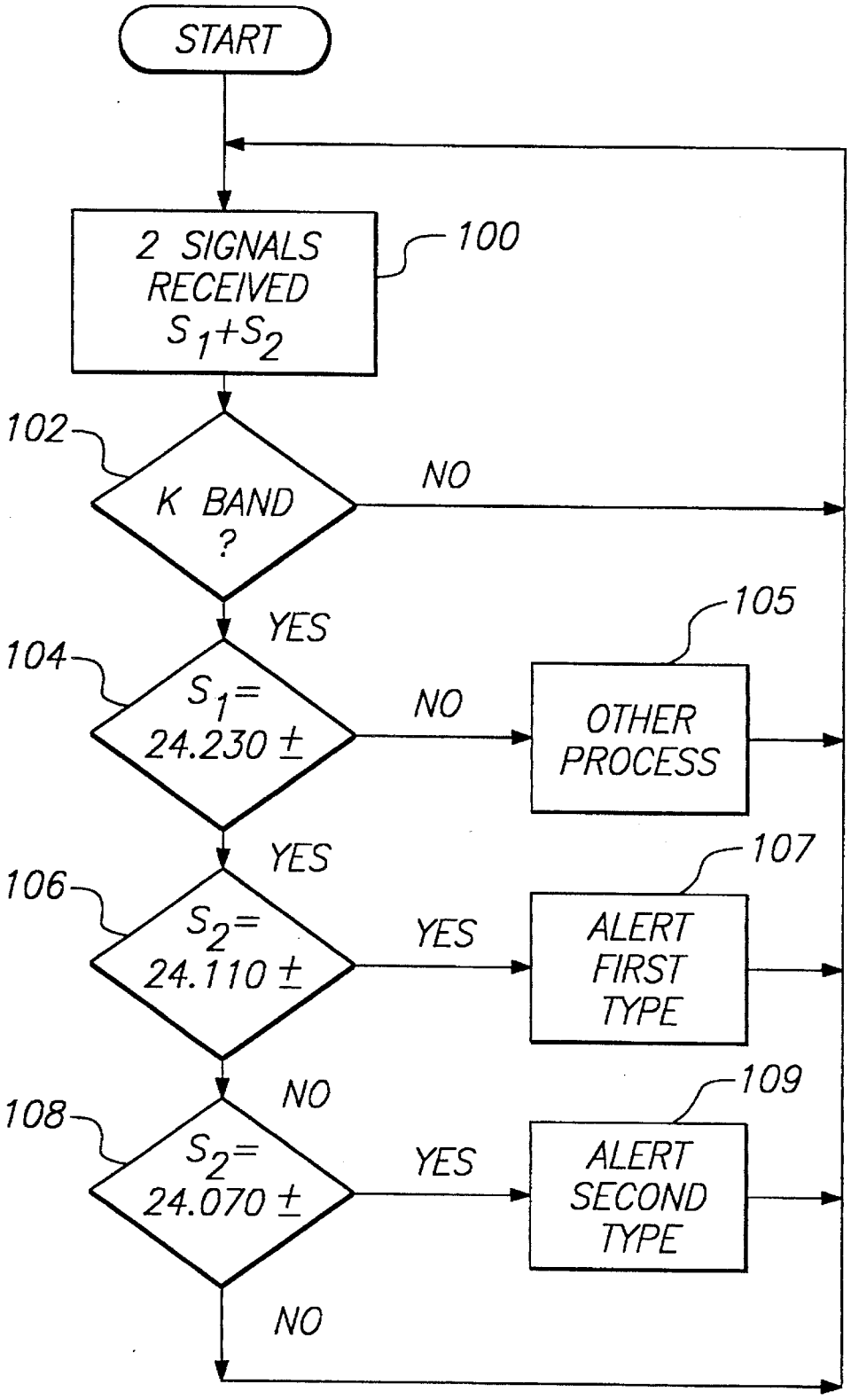
FIG. 4 is a simplified flow chart showing the steps performed in evaluating detected signal pairs.

As explained in U.S. Pat. No. 5,305,007, digital signal processing may be used to effectively evaluate the s-curves to determine whether they represent "valid" detected signals. Because the preferred embodiment of the present invention uses K band sources, the time spacing between s-curve pairs will be approximately 3.4 ms. However, rather than detecting just a single pair of s-curves in the K band, as would be the case for a conventional radar detector, the present invention will discriminate for two or more pairs of s-curves, as shown in FIGS. 3A and 3B. One transmitted signal $S_1$ will be located at one end of the frequency band, and the other transmitted signal $S_2$ will be located at the other end of the frequency band. Likewise, the output of the quadrature detector 34 will be the s-curve pair $S_3$ and $\overline{S}_3$, corresponding to signal $S_1$, and the s-curve pair $S_4$ and $\overline{S}_4$, corresponding to signal $S_2$, separated in a time domain as shown. This can be accomplished by making simple software changes in microprocessor 14 to realize the flow chart illustrated in FIG. 4. It should be obvious that many variations in the flow chart could provide an adequate solution. For example, an illustrative copy of source code is appended hereto and has been shown to work when implemented in Texas Instruments model TMS320C15 DSP chip. Referring to FIG. 4, the microprocessor 14 receives and stores two signals in step 100. An optional step 102 (but implemented in conventional radar detectors) checks to see if the signal(s) received are within the K band. If not, the program loops back. If so, then the microprocessor evaluates the s-curve pairs in step 104 to see if one of the pairs corresponds to 24.230+/–0.020 GHz. If not, the program may perform another process in step 105 (such as conventional police radar detection) and loop back. If so, then the microprocessor evaluates the other s-curve pair in step 106 to see if it corresponds to 24.110+/–0.020 GHz. If so, then an alert corresponding to a first signal type is generated in step 107. If not, then the microprocessor checks in step 108 to see if it corresponds to 24.070+/–0.020 GHz. If so, then an alert corresponding to a second signal type is generated in step 109. If not, then the program loops back.

It should be realized that many solutions could be realized via either hardware or software to implement the present invention. However, as most broadly contemplated, the present invention allows existing radar detectors to be modified through simple software changes to recognize these new emergency classes of signals. Other solutions will be obvious to those skilled in the art.

It should be understood that the invention is not intended to be limited by the specifics of the above-described embodiment, but rather defined by the accompanying claims.

Program Constants calculated in following section

```
                ; X & K band alerts can only occur in the middle third of the x/k/ka-inner
                ; sweep. Find the indicies of the boundaries of this region,

0020 0364 xkleft   .word    xcpts_swp /3        ; Left edge
0021 06c8 xkrite   .word    xcpts_swp *2/3      ; Right edge

                ; Beacon processing assumes that K band spacing of beacon type 1 is 120 mHz
                ; and beacon type 2 is 160 mHz. Calculate the width of each beacon type
                ; in terms of # of indicies.        +++sko162a
```

-continued

```
229        0364 xkpoints      .set      xcpts_swp*2/3 - xcpts_swp/3; # x or k indicies in sweep
230        00f6 kspectrum     .set      ksize/3      ; k-band is 1/3 of total sweep
231   0022 01a7  beacon_narrow          .word     120*xkpoints/kspectrum ; # indicies separating beacon 1
232   0023 0234  beacon_wide          .word     160*xkpoints/kspectrum ; # indicies separating beacon 2
233   0024 0046  beacon_toler     .word     20*xkpoints/kspectrum ; #points in tolerance
234
```

Ram Variables & Flags

```
586   0067          bit     kbl,set5          ; Set if first K Source detected          +++sko162a
587                         ;                   for Beacon Detection.
588   0067          bit     kbw,set5          ; Set if Wide Beacon Source detected +++sko162a
589   0067          bit     kbn,set5          ; Set if Narrow Beacon Source detected +++sko162a
712   007d          .bss    beholdn,1         ; Beacon hold counter for narrow case
713   007e          .bss    beholdw,1         ; Beacon hold counter for wide case
      0077     firstk  equ          tempz     ; Index of first k band pair if beacon source      ; +++sko162a
```

Machine Code for determining presence of 2 Beacon Source Types

```
G  456   06d9  6880  haples: larp   ar0
G  457   06da  3865-      lar       ar0,rindex
G  458                 ;
G  459                 ; Do Beacon detection processing. If 2 K band sources are detected with space
G  460                 ; 'beacon_wide' or 'beacon_narrow', set associated flags kbw or kbn      +++sko162a
G  461   06db              jpclr     beacon,beadone    ; If beacon disabled, prevent beacon processing
G  462   06e0              jclr      ksweep,beadone    ; Is this K band processing?
G  463   06e4              jclr      kbl,kafrst        ; If first K source flag kbl set, test
G  464                                                 ; to see if beacon spacing requirements met.
G  465   06e8  2088            lac     *,0             ; Get the index
G  466   06e9  7901-           and     c1fffh
G  467   06ea  1077-           sub     firstk          ; Calculate spacing back to first k band source
G  468   06eb  7f88            abs
G  469   06ec  5068-           sacl    tempi
G  470   06ed              ld        beacon_wide
G  471   06f0  1068-           sub     tempi
G  472   06f1  7f88            abs
G  473   06f2  5069-           sacl    tempj           ; Store signal spacing in 'tempi'
G  474   06f3              ld        beacon_toler
G  475   06f6  1069-           sub     tempj
G  476   06f7  fa00            blz     notwid          ; If within tolerance of 'beacon_wide',
         06f8 06dd'
G  477                                                 ;    Set 'K Beacon Wide' Flag
G  478   06f9              copyi     60,beholdw
G  479   06fb  f900            b       beadone
         06fc 06f3'
G  480   06fd          notwid: ld    beacon_narrow
G  481   0700  1068-           sub     tempi
G  482   0701  7f88            abs
G  483   0702  5069-           sacl    tempj
G  484   0703              ld        beacon_toler
G  485   0706  1069-           sub     tempj
G  486   0707  fa00        blz       beadone         ; If within tolerance of 'beacon_narrow',
         0708 06f3'
G  487                                                 ;    Set 'K Beacon Narrow' Flag
G  488   0709          copyi         60,beholdn      ; Set beacon hold to 40
G  489   070b  f900        b         beadone
         070c 06f3'
G  490   070d  2088    kafrst: lac     *
G  491   070e  7901-           and     clfffh
G  492   070f  5077-           sacl    firstk          ; Record index of left k band pair
G  493   0710              set       kbl
G  494   0713          beadone:
```

Machine Code constructed to support Various Display Types

```
H  462                 ;    Handle Beacon Processing
H  463
H  464   0a57  207e-   wn:     lac     beholdw         ; Decrement the wide & narrow
H  465   0a58  ff00        bz        atzero          ;    beacon detectors
         0a59 0a3c'
H  466   0a5a  1005-       sub       one             ;    unless
H  467   0a5b  507e-       sacl      beholdw         ;      they are allready
H  468   0a5c  207d-   atzero: lac     beholdn         ;      equal to zero.
H  469   0a5d  ff00        bz        atzerol
         0a5e 0a41'
H  470   0a5f  1005-       sub       one
H  471   0a60  507d-       sacl      beholdn
H  472   0a61          atzerol:
H  473   0a61  207e-       lac       beholdw         ; If both beacon hold counters +++sko170
H  474   0a62  7a7d-       or        beholdn         ;      (either narrow or wide)
```

-continued

```
H  475  0a63  ff00        bz        bazero      ;      are at 0, clear the beacon indicators
        0a64 0a5f'
H  476  0a65  207e-  squir:   lac    beholdw
H  477  0a66  107d-       sub       beholdn          ; Alert type will be based on largest value.
H  478  0a67  fc00        bgz       calwid
        0a68 0a51'
H  479  0a69         set       kbn
H  480  0a6c         clr       kbw
H  481  0a6f  f900        b         wasnar
        0a70 0a57'
H  482  0a71         calwid: set       kbw
H  483  0a74              clr       kbn
H  484  0a77         wasnar: clr       xalert,kalert,kaalrt ; If in beacon 'hold' interval, leave
H  485  0a7a         set       kalert           ;    in k-bank alert only. Allow
H  486  0a7d  f900        b         qbe
        0a7e 0a6b'
H  487  0a7f  7e60   bezero: lack      kbn+kbw       ; Was either kbn or kbw set in previous sweep?
H  488  0a80  7923-       and       kbn_i
H  489  0a81  ff00        bz        qbe
        0a82 0a6b'
H  490  0a83         copy      clfffh.xktime     ; If so, Terminate alert here by
H  491  0a85  5056-       sacl      tmout     ;          advancing xktime and tmout
H  492  0a86         clr       kbn,kbw
H  493  0a89  f900        b         endalr
        0a8a 0b62'
H  494  0a8b         qbe:
H  601  0aec         jclr      kbw,smearl        ; If beacon, substitute 2 appropriate sounds.
H  602  0af0         copyi     beacl,xsound
H  603               .if lcd
H  604  0af2         copyi     emer3,tempu       ; Display 'Road Hazzard' on LCD display
H  605  0af4  7e49'       lack      emer4
H  606  0af5  f900        b         ysim
        0af6 0ae0'
H  607               .endif
H  608  0af7         smearl: jclr      kbn,smear2
H  609  0afb              copyi     beac2,xsound
H  610               .if led
H  611  0afd              copyi     emerl,temptu      ; Display 'Emergency Vehicle' on LCD display
H  612  0aff  7e3c'       lack      emer2
H  613  0b00  f800   ysim: call        botl
        0b01 0e53'
H  614               .endif
```

We claim:

1. In a radar detector having means for detecting the presence of a radio frequency signal within a preselected frequency band and means for generating an alert thereto, wherein in the improvement, the detecting means includes means for distinguishing at least two discrete radio frequency signals each of which is fixed at a different frequency within the preselected frequency band and means for generating a modified alert upon detecting and distinguishing the discrete signals, wherein the discrete signals are fixed so as to differ in frequency by at least 40 MHz.

2. A system for emergency vehicle detection, comprising:

transmitter means mounted in an emergency vehicle for generating and transmitting a pair of radio frequency signals each fixed in a preselected frequency band and separated by a distinguishable amount, wherein the transmitter means includes means for selecting from a plurality of pairs of radio frequency signals, each pair being uniquely separated by a distinguishable amount;

receiver means carried in a second vehicle for detecting the pair of signals and for distinguishing the one signal from the other signal; and means for generating an alert upon detecting and distinguishing the pair of signals.

3. A system as in claim 2, wherein the pair of signals are fixed so as to differ in frequency by at least 40 MHz.

4. A system as in claim 2, wherein the transmitter means includes means for selecting the frequency for one or more of the signals, and wherein a first signal is fixed at a first preselected frequency and a second signal is selectable between a second preselected frequency and a third preselected frequency.

5. A system as in claim 4, wherein the first signal is fixed at 24.230+/−0.020 GHz and the second signal is selectable between 24.110+/−0.020 GHz and 24.070+/−0.020 GHz.

6. A system as in claim 2, wherein a first pair of signals differs in frequency by 120 MHZ and a second pair of signals differs in frequency by 160 MHz.

* * * * *